United States Patent [19]

Credit

[11] Patent Number: 4,659,111

[45] Date of Patent: Apr. 21, 1987

[54] MIRROR MESSAGE LABEL

[76] Inventor: Lawrence Credit, 24391 Chrisanta Dr., Mission Viejo, Calif. 92691

[21] Appl. No.: 778,892

[22] Filed: Sep. 23, 1985

[51] Int. Cl.[4] ..... G09F 3/00; G09F 3/10

[52] U.S. Cl. ..... 283/81; 283/94; 40/2 R

[58] Field of Search ..... 283/81; 40/2 R, 219, 40/310, 900

[56] References Cited

U.S. PATENT DOCUMENTS

| | | | |
|---|---|---|---|
| 1,212,392 | 1/1917 | Palm, Jr. | 40/2 R |
| 2,603,899 | 7/1952 | Leander | 40/125 |
| 2,810,978 | 10/1957 | Chapman | 40/310 |
| 3,017,713 | 1/1962 | Butler | 40/135 |
| 3,106,032 | 10/1963 | Morgan | 40/135 |
| 3,140,579 | 7/1964 | Skakel, Jr. | 40/219 |
| 4,068,028 | 1/1978 | Samonides | 428/40 |
| 4,123,853 | 11/1978 | Dickensheet | 35/77 |
| 4,268,985 | 5/1981 | Lecznar | 40/219 |
| 4,505,497 | 5/1985 | Katzman | 283/81 |

FOREIGN PATENT DOCUMENTS

| | | | |
|---|---|---|---|
| 491843 | 4/1953 | Canada . | |
| 0977256 | 3/1951 | France | 283/81 |

*Primary Examiner*—Howard N. Goldberg
*Assistant Examiner*—Taylor J. Ross

[57] ABSTRACT

A mirror message label system is provided comprising a transparent plate mirror body having a viewing surface disposed on one side thereof and a reflecting surface disposed on the other side thereof. A flexible, planar label is provided having generally planar front and back surfaces. Indicia is disposed on the front side of the label for direct viewing. Complementary indicia is disposed on the backside of the label, the complementary indicia appearing backward for indirect viewing as a mirror image on a reflective surface. A mounting arrangement is provided for mounting the label on the viewing surface of the plate mirror body with the backside facing the reflective surface of the mirror. This facilitates the simultaneous viewing of indicia disposed on the front side of the label and the mirror image of the complementary indicia disposed on the backside of the label.

9 Claims, 6 Drawing Figures

MIRROR MESSAGE LABEL

BACKGROUND OF THE INVENTION

The invention relates generally to stickers or labelling systems and, more particularly, is directed to a dual-sided label for creating a mirror or reflected message.

Duplex adhesive displays or labels are known in the prior art. Such duplex advertising or directional displays are provided with directional material or indicia on both sides thereof and an adhesive surface which may be attached to a pane of glass so that advertising material or indicia on both sides of the display will be unobstructed and clearly visible from opposite sides of the glass.

SUMMARY OF THE INVENTION

According to the present invention, a mirror message system is provided. The mirror message system of the present invention is thought to be particularly desirable to children and young adults who collect and use amusing and/or aesthetically-pleasing self-adhesive labels. However, the mirror message system of the present invention is also thought to have utilitarian applications.

The message system comprises a transparent, plate mirror body having a relatively flat viewing surface disposed on the front side of the body and a relatively flat reflective surface disposed on the back of the body. A relatively flexible, flat, planar label is provided having a front side and a backside. Indicia is disposed on the front side of the label for direct viewing by the user. Complementary indicia is disposed on the backside of the label, the complementary indicia appearing backward for indirect viewing as a mirror image on the reflective surface of the mirror. An adhesive layer is disposed on the backside of the label for mounting the planar label on the viewing surface of the mirror.

In another embodiment the label is formed from a polymeric material that has self-adhesive properties for mounting the label on the mirror. This facilitates the simultaneous viewing of both the indicia disposed for direct view on the front of the mirror and the complementary indicia disposed on the back of the label as a mirror image reflected through the viewing surface of the mirror. When the sticker is mounted on the viewing surface of a mirror, the viewer is at first greeted by the message or design on the front side of the label, but upon closer inspection, the viewer is amused or entertained by the message or design visible in the reflection of the back of the label in the mirror. Often it is desirable to place the first portion of a message on the front of the label and finish the message with a hidden portion on the back of the label that only becomes apparent upon closer inspection by the viewer.

Preferably, the mirror comprises a transparent plate having a substantially uniform predetermined thickness and preferably the label is provided with an elongate shape having a substantially uniform, predetermined width. A predetermined label width is provided which is substantially equal to or greater than the predetermined thickness of the mirror to optimize viewing of the mirror message at an incident angle of approximately 45 degrees. Although the mirror message labels of the present invention can be designed for application to a wide variety of diverse mirror structures, in one preferred embodiment of the invention, the mirror message system may be disposed on an article of jewelry such as a pendant or a locket. dr

DESCRIPTION OF THE PREFERRED EMBODIMENTS

With reference now to the figures, and in particular FIGS. 1–4, the mirror message system of the present invention is generally illustrated at 10. The mirror message system 10 comprises a transparent, plate mirror body 11 having a front viewing surface 12 and a back reflecting surface 14. While in the present embodiment a plate or plain mirror is preferred, it should be understood that mirror bodies having alternative shapes and perhaps curvilinear reflecting surfaces for amplifying or distorting the reflected image may be preferred in alternative embodiments.

Figure 3:
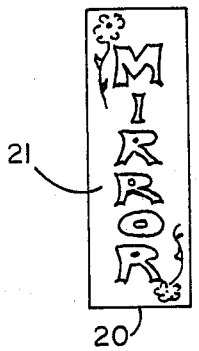
FIG. 3 is a top plan view of the mirror message label of the present invention.
Figure 4:
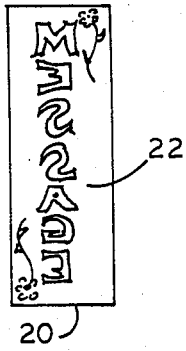
FIG. 4 is a bottom plan view of the mirror message label of the present invention.

A relatively flat, planar label is provided at 20. The label 20 is provided with a front side 21 and a backside 22. Indicia such as the word "mirror" is printed or otherwise suitably disposed on the front side 21 of the label 20, as illustrated in FIG. 3 for direct viewing by an observer (hereinafter direct indicia). Similarly, complementary indicia is printed or otherwise suitably affixed to the backside 22 of the label 20, as illustrated in FIG. 4, where the word "message" is affixed to the backside of the label. As illustrated in FIG. 4, preferably the complementary indicia is printed backward to later facilitate indirect viewing of the indicia as an image reflected in a mirror surface.

In one embodiment of the invention the label 20 is formed from a transparent polymeric material. This alleviates the need to print the complementary indicia backward. In this embodiment the complementary indicia is printed normally (as it would be printed for direct viewing) on the front of the transparent label. The mirror image or backward image of the complimentary indicia thus "appears" on the backside of the transparent label. While many other printing steps are possible to produce multi-color designs on either the back or front of the label, at least one opaque background layer is generally printed over the complementary indicia and the direct indicia is printed thereover.

Preferably, means for mounting the planar label on the viewing surface 12 of a mirror is provided comprising a layer of adhesive distributed on the back surface 22 of the label 20. This facilitates affixation of the generally planar label 20 on the viewing surface 12 of the mirror 11 by removing a suitable backing material which may be used to protect the self-adhesive label and then flattening the label with the backside down on the viewing surface of the mirror. Simultaneous viewing of both the direct indicia disposed on the front side of the label and the complementary indicia disposed on the backside of the label is thus facilitated by providing for the direct viewing of the front of the label and the indirect viewing of the mirror message disposed on the back of the label as a mirror image viewed through the viewing surface of the mirror.

In another embodiment of the invention the label 20 is formed from a thin sheet of polymeric material having self-adhesive qualities which cause it to cling to smooth surfaces such as the glass surface of a mirror. This facilitates the removal, replacement or reuse of the labels. Many such materials are known in the wrapping and packaging art under various trade names.

Figure 2:
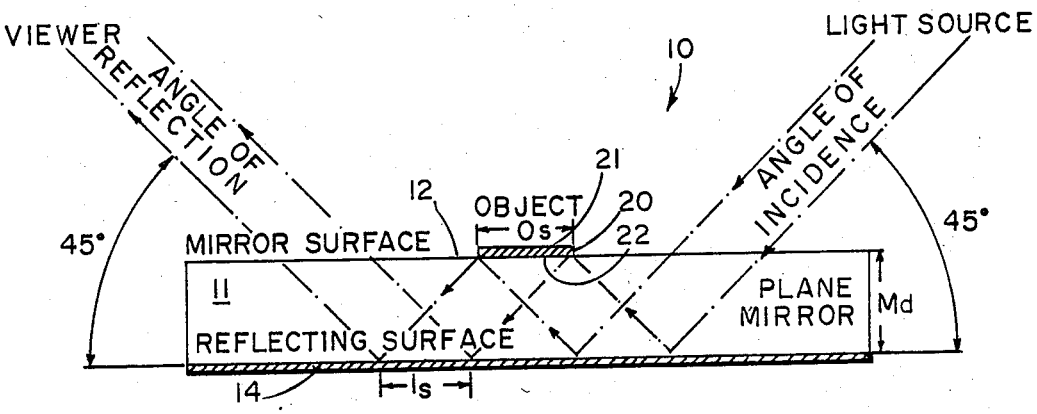
FIG. 2 is an elevational view, partially in section, of the mirror message system of the present invention.
Figure 1:
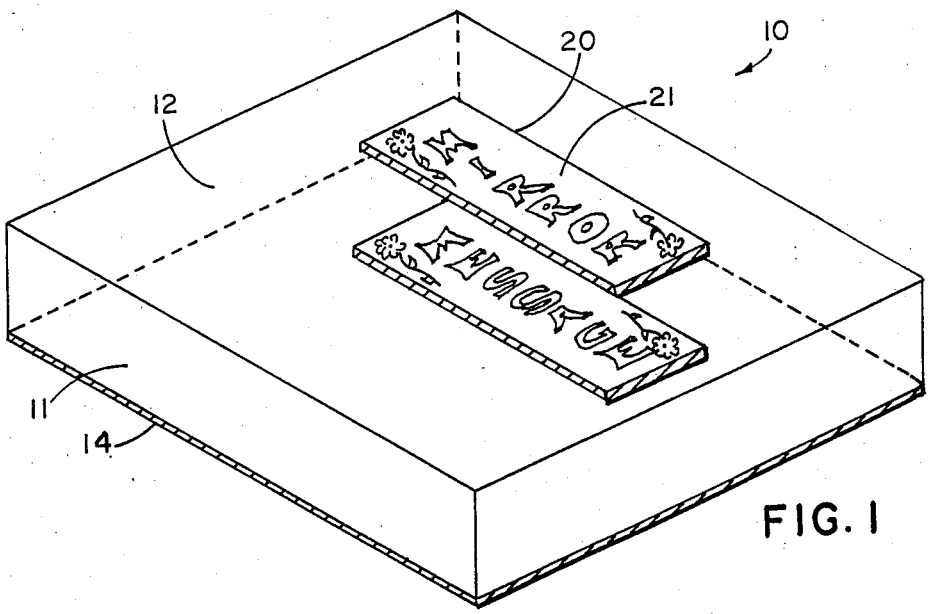
FIG. 1 is a perspective view of the mirror message system of the present invention.

As best illustrated in FIG. 2, for best results, the mirror is provided with a substantially uniform thickness, or mirror diameter (Md) and the label 20 is provided with an elongate shape of uniform width or object size (Os) which is equal to the mirror diameter. Optimum results seem to be provided when object size (Os), image size (Is) and mirror diameter (Md) are equal ($Os=Is=Md$). However, it is most important that the mirror diameter (Md) is substantially equal to or greater than the object size (Os), or ($Md \geqq Os$).

As previously mentioned, the mirror message system of the present invention is thought to be particularly adapted to adolescents and young adults who collect or use self-adhesive stickers primarily for the purposes of amusement. The user of such a sticker would place the sticker on a suitable mirror viewing surface and a person first encountering the label would first be greeted by the message or design disposed on the front side of the label. Thereafter, however, on closer inspection the viewer would be greeted and perhaps amused by the complementary message or design disposed on the back of the label and viewed as a reflection off of the reflecting surface of the mirror. However, it should be recognized that the mirror message system of the present invention may be useful an article of utility for conveying advertising and/or more general display information.

Figure 5:
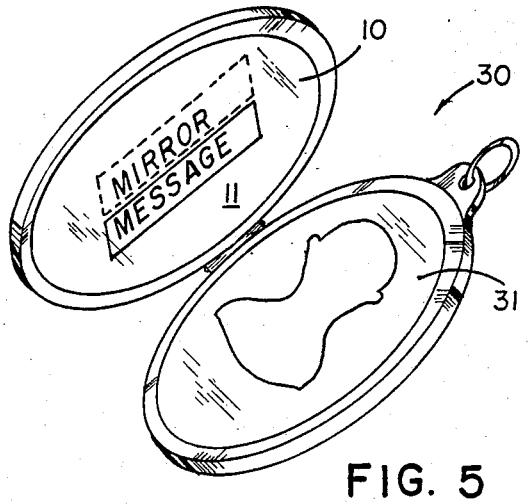
FIG. 5 is a perspective view of an article of jewelry embodying the mirror message system of the present invention.
Figure 6:
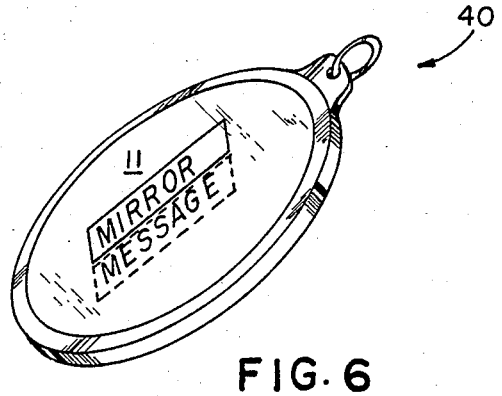
FIG. 6 is a perspective view of another article of jewelry embodying the mirror message system of the present invention.

As illustrated in FIGS. 5 and 6, the mirror message system 10 of the present invention may be incorporated in a locket or pendant, generally illustrated at 30 and 40, respectively. In the case of the locket 30, the mirror 11 is disposed on one half of a clamshell-type locket which is designed to also hold a suitable photograph at 31. However, as illustrated in FIG. 6 at 40, the mirror 11 may be disposed on a simple pendant having a reflective surface incorporated therein. Still further, it should be recognized that the mirror message system of the present invention may be adapted to a wide variety of mirrored surfaces such as vanity mirrors, compact mirrors, bathroom mirrors, rearview mirrors, etc.

The above description is exemplary and should be considered that of the preferred embodiment only. Modifications of the invention will occur to those who make and use the invention. It is desired to include within the scope of the present invention all such modifications that come within the proper scope of the appended claims.

The embodiments of the invention in which an exclusive property or privilege is claimed are described as follows:

1. A mirror message system comprising:
a transparent mirror body;
a viewing surface disposed on said mirror body;
a reflecting surface disposed on said mirror body;
said transparent mirror body having a predetermined mirror diameter (Md) substantially equal to the distance between said viewing surface and said reflecting surface;
a planar label;
said planar label being provided with an elongate shape having a predetermined width that defines an object size (Os);
a front side disposed on said planar label;
a backside disposed on said planar label;
direct indicia disposed on said front side of said label for direct view;
complementary indicia appearing on said backside of said label, said complementary indicia appearing backward for indirect viewing as a mirror image on said reflecting surface; and
means for mounting said planar label on said mirror with said backside facing said reflective surface, said mirror message system being provided with a mirror diameter (Md) that is substantially equal to or greater than said object size (Os) whereby said complementary indicia is readily reflected on said reflecting surface for viewing through said viewing surface of said mirror simultaneously with said direct indicia.

2. The mirror message system of claim 1 wherein said complementary indicia is disposed on and printed backward on said backside of said label.

3. The mirror message system of claim 1 wherein said means for mounting comprises a layer of adhesive disposed on said backside of said label for mounting the same on said viewing surface of said mirror.

4. The mirror message system of claim 1 wherein said mirror body comprises a transparent plate having a substantially uniform predetermined thickness, said viewing surface being disposed on the front side of said plate and said reflective surface being disposed on the backside of said plate.

5. The mirror message system of claim 1 wherein said planar label comprises a clear sheet of polymeric material having the following sequentially printed on the front side thereof: said complementary indicia, an opaque layer, and said direct indicia.

6. The mirror message system of claim 5 wherein said planar label comprises a thin flexible sheet of polymeric material of the type which inherently clings to smooth surfaces.

7. The mirror message system of claim 1 wherein said mirror body is disposed on an article of jewelry.

8. The mirror message system of claim 7 wherein said mirror body is disposed on a pendant.

9. The mirror message system of claim 7 wherein said mirror body is disposed in a locket.

* * * * *